United States Patent [19]

Caughey

[11] Patent Number: 4,888,885

[45] Date of Patent: Dec. 26, 1989

[54] DRYER FOR COMBUSTIBLE CHIP-LIKE MATERIAL

[75] Inventor: Robert A. Caughey, Antrim, N.H.

[73] Assignee: New Hampshire Flakeboard, Inc., Antrim, N.H.

[21] Appl. No.: 122,045

[22] Filed: Nov. 18, 1987

[51] Int. Cl.[4] ..... F26B 3/00

[52] U.S. Cl. ..... 34/33; 34/57 C; 34/182

[58] Field of Search ..... 34/10, 33, 57 A, 57 B, 34/57 C

[56] References Cited

U.S. PATENT DOCUMENTS

| | | | |
|---|---|---|---|
| 456,732 | 7/1891 | Mey . | |
| 663,868 | 12/1900 | Crean . | |
| 1,669,012 | 5/1928 | Nordstrom . | |
| 1,892,233 | 12/1932 | Chappell . | |
| 1,985,250 | 12/1934 | Goss et al. | 34/34 |
| 2,148,946 | 2/1939 | Hubmann et al. . | |
| 2,315,207 | 4/1943 | Winter | 34/10 |
| 2,548,262 | 4/1951 | Hintz | 34/171 |
| 2,911,730 | 11/1959 | Schaub et al. | 34/57 |
| 2,974,420 | 3/1961 | Kearton et al. | 34/10 |
| 3,056,214 | 10/1962 | Andersen, Jr. . | |
| 3,064,592 | 11/1962 | Eberhardt | 110/ |
| 3,068,584 | 12/1962 | Schaub et al. | 34/8 |
| 3,195,241 | 7/1965 | Hohne | 34/10 |
| 3,404,467 | 10/1968 | Burgherd | 34/56 |
| 3,449,840 | 6/1969 | Francis | 34/187 |
| 3,526,969 | 9/1970 | Alms et al. . | |
| 3,633,137 | 9/1974 | Matthews | 34/168 X |
| 3,736,667 | 6/1973 | McClaren | 34/46 |
| 3,795,987 | 3/1974 | Kemmetmueller | 34/168 |
| 3,864,845 | 2/1975 | Cooper | 34/171 |
| 3,879,857 | 4/1975 | Neville | 34/10 |
| 4,050,900 | 9/1977 | Hobbs et al. | 34/40 X |
| 4,149,844 | 4/1979 | Noyes | 432/17 |
| 4,249,891 | 2/1981 | Noyes et al. | 432/14 |
| 4,258,476 | 3/1981 | Caughey | 34/174 |
| 4,270,899 | 6/1981 | Faulkner et al. | 432/58 |
| 4,308,669 | 1/1982 | Noyes et al. | 34/33 |
| 4,371,375 | 2/1983 | Dennis, Jr. et al. | 34/57 D X |
| 4,406,676 | 9/1983 | Potter | 34/134 X |
| 4,445,282 | 5/1984 | Heinemens | 34/168 |
| 4,530,700 | 7/1985 | Sawyer | 34/227 X |
| 4,595,958 | 6/1978 | Caughey | 34/57 C X |
| 4,629,421 | 12/1986 | Kreisberg et al. | 34/174 X |
| 4,727,657 | 3/1986 | Miller | 34/57 C X |

FOREIGN PATENT DOCUMENTS

| | | | |
|---|---|---|---|
| 672457 | 7/1979 | U.S.S.R. | 34/168 |
| 1402543 | 8/1975 | United Kingdom | 34/57 C |

*Primary Examiner*—Henry A. Bennet
*Attorney, Agent, or Firm*—Lahive & Cockfield

[57] ABSTRACT

A dryer (10, 50, 100) for drying combustible, chip-like material has at least one ramp-like transport (12) inclined at an angle between five and ten degrees steeper than the natural angle of repose of the material. The transport (12) supports substantially laminar flow of a bed of material from a material feed element (40) to a material discharge element (48). The dryer feed element (40) may include a material size separator for depositing finer chips below larger chips of material so as to stratify the bed and reduce particulate entrainment. The dryer (10, 50, 100) preferably has modular construction for nesting a plurality of stacked transports (12) compartly within a common enclosure (52, 102).

29 Claims, 6 Drawing Sheets

DRYER FOR COMBUSTIBLE CHIP-LIKE MATERIAL

Field of the Invention

The invention generally relates to a dryer for combustible, chip-like material, and to a process for drying such material.

BACKGROUND AND OBJECTIVES OF THE INVENTION

The burning of wood chips and other combustible chip-like materials is desirable or even necessary, for example as an alternative fuel or in the production of heat. It is also desirable to burn chip-like material to dispose of waste from industrial processes, such as from a paper mill, in a manner that recovers energy.

Unfortunately, the chips produced from recently harvested trees usually contain from 40% to 50% moisture. While chips containing this much moisture can be burned, chips dried to have a 10% to 15% water content can be burned with higher efficiency, and with significant increase in the capacity of a boiler plant.

The technology peculiar to chip drying has heretofore not adequately addressed the needs of many applications. Consequently, many plants still burn green chips, and much combustible waste which can be in chip form is not recovered.

However, it has been demonstrated that chips can be dried efficiently in a dryer using waste heat from flue gas or heat from another drying medium. The use of such a dryer can substantially reduce boiler plant operating costs, both by reducing the fuel requirement and by improving plant output. In designing a dryer for chip-like combustible material, several factors stand out. These include thermal efficiency and temperature control, gas flow, material handling, and use of space. The treatment of such factors governs the rate and efficiency, and overall suitability, of the drying.

The selection of the operating temperature, and the realizable thermal efficiency of the dryer at that temperature, depend on the nature of the material to be dried. In drying materials such as wood chips, in which moisture is locked within the body of the chip and is evaporated from the chip's surface during drying, the ratio of chip surface area to volume is important.

Also important is the rate at which a chip can be dried, and this depends at least in part on gas flow and temperature. However, increasing the temperature to improve the drying speed has limits, imposed by the need to avoid pyrolysis of the chips, which for wood chips can commence at temperatures as low as 400° F. to 450° F.

Increasing flow velocity of the heating medium also has limits, imposed for example by the power required to move the gas, and the desirability of avoiding fluidizing solids in the dryer. An often more stringent constraint on gas flow velocity is the desirability of avoiding particulate entrainment, i.e., the carrying away of small particles. For many applications, particulate entrainment in the exhaust is unacceptable by air quality standards, and necessitates subsequent air cleaning.

Several issued patents aid in placing the present invention in context.

U.S. Pat. No. 4,530,700 of Sawyer discloses apparatus for preparing wood chips and other bio-mass material at the harvesting site for consumption as a fuel or chemical feed stock. The apparatus includes a dryer section and a gas producing section. The gas producing section consumes green chips and delivers hot combustion gases to the drying section for drying other green chips.

In the earlier U.S. Pat. No. 4,258,476 of Caughey, a dryer for particulate material such as sawdust has a generally vertical, stack-like drying chamber defined by louvered baffle plates which are reciprocated in advancing the sawdust. In normal operation, the dryer is maintained full of sawdust. The relatively tall column of material in the drying chamber is in the path of flowing air.

In U.S. Pat. No. 4,371,375 of Dennis, an apparatus for drying sawdust and wood chips has an upright housing with a plurality of vertically-spaced, horizontally-disposed dryer plates. Each plate has spaced-apart openings through which sawdust introduced at the top of the housing may pass in sinuous fashion. As warm air flows upwardly in the housing, the falling sawdust is agitated on each plate.

An object of this invention is to provide an improved dryer for chip-like material.

A further object of the invention is to provide a dryer with improved thermal efficiency and temperature control, while avoiding pyrolysis of the dried material.

Yet a further object of the invention is to provide a dryer with improved gas flow characteristics and gas handling power requirements, and reduced particulate entrainment.

A further object of the invention is to provide a dryer with improved material handling, and which provides increased capacity and improves space utilization, preferably through a modular design.

SUMMARY OF THE INVENTION

These and other objectives of the invention are achieved by a dryer for chip-like material, such as wood chips, pelletized paper sludge or other chip-like biomass, and which has an inclined ramp-like transport, a structure for introducing a flow of warm gas to the transport, a material feed element and a material discharge element. The transport typically has first and second parallel sides, an inclined louvered and generally planar ramp bottom, and a gas-permeable top material-retaining element.

The ramp bottom can extend longitudinally between a top feed end and a bottom discharge end and laterally between the sides for supporting a bed of material. The material can move down the transport solely due to the force of gravity. This is attributable to the angle of inclination of the ramp, which is steeper than the natural angle of repose of the dried material at the discharge end, preferably by 5° to 10°.

The ramp bottom is structured to distribute drying gas, i.e. air, and to provide sufficient flow with limited velocity to the bed of material being dried; and to this end preferably has a plurality of louver vanes. Adjacent louver vanes are separated by a louver opening or space for permitting a drying gas to flow through the ramp bottom.

The top material retainer is disposed in spaced, typically parallel relation to the ramp bottom and intermediate the transport sides, forming therebetween a chute of preferably rectangular cross-section. The top retainer, in a preferred instance, includes a plurality of spaced, parallel, elongate members, such as slats, rails, or pipes, forming a longitudinal array parallel with the transport sides and extending between the top feed end and the bottom discharge end. The top retainer assists in preventing slumping of the bed of material as it flows down the transport. The retainer preferably presents low resistance to exhaust of the drying gas, and presents low drag to the chip material advancing on the transport. Preferably, the elongate members contact the top of the bed of material and have a lateral width substantially less than the width between adjacent members. The distance between the top retainer and the ramp bottom, i.e., the thickness of the chute, determines the depth of the bed.

A flow of warm gas, such as flue gas or warm dry air, is provided to the bottom of the bed of chips. The gas preferably is fed through the louver openings in the transport bottom and rises through the gas-permeable bed in the chute along a thickness dimension as measured orthogonally between the ramp bottom and the top retainer. Then it passes out through the top retainer.

The feed element for introducing the material into the chute at the top feed end includes a main feed duct disposed above that end of the transport to deposit or drop the material on the transport.

The discharge element removes dried material from the transport at the discharge end, and includes a transport such as a shuttle, auger, conveyor or other known expediency.

The feed, transport, gas-introducing and discharge elements cooperate to maintain the bed moving in a controlled manner with minimal mixing of the chips. The movement of the chip material ideally has low turbulence and hence can be viewed as being of a laminar nature. The drying gas is well distributed and free of excessive flow rates. The humidified, cooled gas exits from the bed substantially free of entrained particulates. The bed depth and composition profile are selected and preferably controlled to scrub and maintain the gas free of particulates, the particulates being trapped within the bed by the material itself. To promote the scrubbing action of overlying chips, the feed for introducing the material into the chute is preferably provided with a material sizing device, e.g., a vibratory screen. The sizing device orders the material by size, and places the smaller chips nearer the ramp bottom and below the larger chips. Thus, the bed composition profile is controlled.

A dryer according to the invention thus dries chip material advancing on a transport and is characterized in part by relatively efficient operation with a low pressure flow of warm gas, and by exhaust gas that has a low level of particulates, even where the incoming warm gas carries particulates. A further feature is that the exhaust gas has a low temperature determined primarily by the incoming temperature of the wet chips. The dryer generally operates continuously, although the transport advance can be stopped or slowed, as to provide a longer dwell time.

In accordance with another aspect of the invention, and for increased drying capacity or through-put, the dryer preferably is of modular construction, having a plurality of the above-described transports in stacked or nested relation. The transports can be nested with their top feed ends and bottom discharge ends vertically arranged, or alternatively, horizontally arranged. In the vertical nested arrangement of the transports, preferably the feed end of one is vertically above the feed end of the next one above it. In the horizontal nested arrangement of the transports, the feed end of one is located horizontally between the feed and discharge ends of the adjacent one.

In a stacked embodiment, the dryer further comprises a box-like enclosure.

In one specific instance of a multi-unit dryer, a flow of gas is directed through a gas inlet plenum disposed between a first enclosure side wall and a first wall of the transports, and then to each of the ramp undersides in parallel for passage through each of the beds of material in each of the chutes. Subsequently, the cooled, humidified gas from each flows to an exhaust plenum disposed between a second enclosure side wall and the second transport side walls. A barrier or deflector plate spans between each pair of adjacent transports for directing dying gas to the underside of a transport and for directing spent gas from the top of an adjacent transport. The multi-transport dryer of the invention thus can be assembled with a selected number of dryer modules, a deflector plate for each, and common input and output plenums, feed and discharge mechanisms, and a housing for the assemblage.

BRIEF DESCRIPTION OF THE DRAWINGS

For a fuller understanding of the features, advantages and objects of the invention, reference should be made to the following detailed description and the accompanying drawings, in which.

DESCRIPTION OF ILLUSTRATED EMBODIMENTS

Dryer Unit

Figure 1:
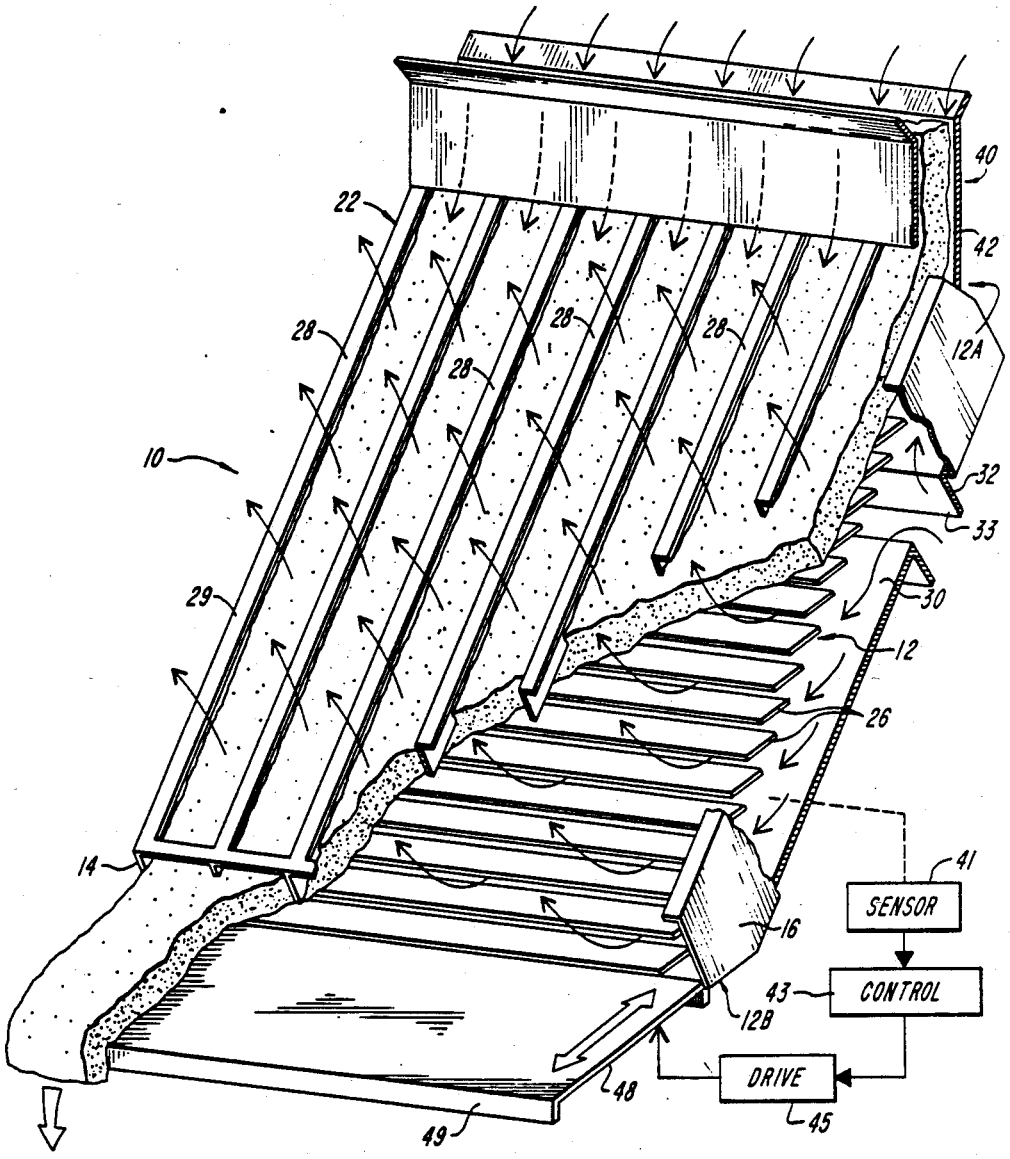
FIG. 1 is a fragmentary perspective view, partly broken away, of a continuous dryer in accordance with an embodiment of the invention.
Figure 2:
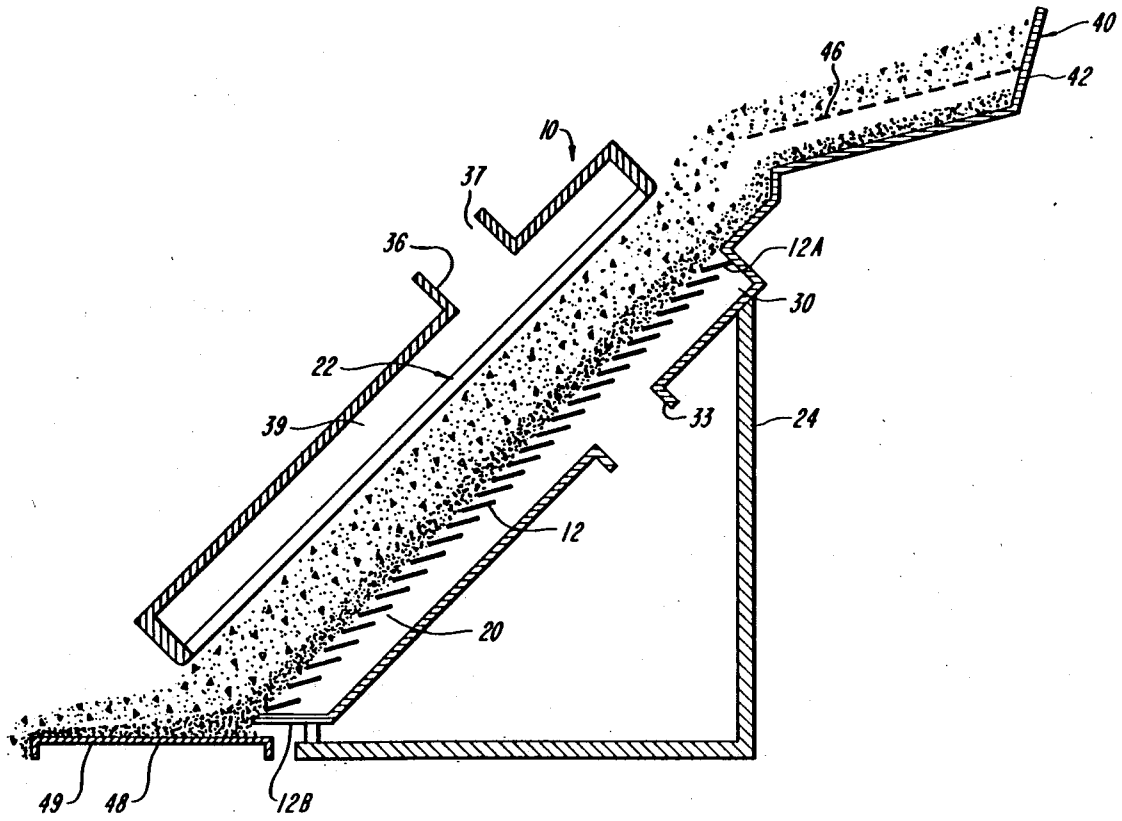
FIG. 2 is a schematic, side elevational view, in section, of a dryer in accordance with a variation of the foregoing embodiment of the invention.

Referring to the drawings, in which the same reference number refers to similar elements, FIGS. 1 and 2 show a continuous dryer 10 in accordance with a first embodiment of the invention.

The illustrated dryer 10 is specifically designed to dry combustible, chip-like material such as, for example, wood chips or pelletized paper mill sludge or other bio-mass, and to thereby prepare the material for further processing, such as by a burner or gasifier as described in further detail below.

Central to the dryer's design is an inclined ramp-like transport 12 down which a bed of the material moves in a regulated fashion. This material advance preferably is due solely to the force of gravity. The advance is longitudinal, from a top, material feed end 12A to a bottom, material discharge end 12B. A steady stream of a warm gas, such as flue gas or warm air, dries the material during its passage on the transport.

The illustrated transport 12 includes first and second parallel transport side walls 14, 16, an inclined, louvered and generally planar ramp bottom 20, and a gas-permeable retainer 22 formed with top rails 28 disposed in spaced, substantially parallel relation to the ramp bottom 20.

The ramp bottom 20 spans longitudinally between the top material feed end 12A and the bottom discharge end 12B, and laterally between the transport side walls 14, 16. The ramp bottom 20 is supported at a selected angle of inclination by means of transport supports 24. The angle of inclination is selected to maintain a free flow of material through the dryer 10 without significant mixing, turbulence or other disturbance within the bed of material being dried, and typically without an external transport drive element, i.e. solely by gravity. This laminar, coherent type material advance which the invention attains is desired to avoid particle-to-particle abrasion which would give rise to the development of fine particles, and to avoid dislodging fine particles already on the chips which could become entrained in the exhaust. It is also deemed desirable to enhance uniform drying.

The slope angle of the ramp bottom 20 is selected to be approximately five to ten degrees steeper than the natural angle of repose of the specific material being dried. The natural angle of repose for relatively dry material is determined by techniques well known to one skilled in the art. Conceptually, if one were to drop a continuous stream of the material on a flat, horizontal surface from a point source, a conical mound would form having sides disposed at an angle to the surface, i.e., at the natural angle of repose.

Generally speaking, the illustrated transport slope angle for drying wood chips is substantially in the order of 40 to 50 degrees relative to the horizontal, while for pelletized paper mill sludge it is substantially in the order of 40 to 55 degrees.

With further reference to FIGS. 1 and 2, the louvered ramp bottom 20 includes a plurality of louver vanes 26 extending laterally between the transport sides 14, 16 and disposed to support the bed, and to define, between adjacent vanes, an opening for the admission of gas. Each louver opening is, for example, approximately one-eighth inch (0.3 cm) wide as measured orthogonally between adjacent louver vanes 26. As apparent in FIG. 2, the louver vanes 26 are disposed at a shallower incline to the horizontal than the angle of inclination of the ramp bottom 20. With this vane configuration, the drying gas is admitted to the particle bed, while the chip-like material does not leak or spill out between the vanes. Each louver vane, in the foregoing specific illustrative example, is approximately one and one-half inches (3.8 cm) long and overlays the underlying vane alone 20–25% of its length. The size and orientation of the louver vanes 26 and louver openings depicted in the drawings are exaggerated for clarity of illustration.

As shown in FIG. 1, the top retainer 22 is disposed longitudinally along the length of the transport 12 and intermediate the side walls 14, 16. The illustrated top retainer 22 includes a plurality of elongate, spaced, parallel members 28, such as slats or rails of square (see FIG. 6) or rectangular cross-section or pipes, forming a longitudinal array serving to prevent slumping of the bed of material as it flows down the transport 12. As such, it preferably provides low air resistance and low particle drag. Preferably the elongate members 28 each have a lateral width substantially less than the width between adjacent elongate members. Continuing with the illustrative example, the elongate members 28 have a lateral width on edge of one-eighth inches (0.3 cm), while the intervening space is approximately one and one-half inches (3.8 cm). The transport side walls 14, 16, bottom 20 and top retainer 22 thus bound a space, illustratively of rectangular cross-section, which functions as a bed-receiving chute.

In use, the ramp bottom 20 supports the bed of material with a selected depth, as measured in a thickness dimension orthogonally from the ramp bottom 20 to the top of the bed, i.e., equal to the thickness of the chute. Preferably also, the chute is maintained full of the material so that no gaps form in the flowing bed.

The dryer 10 as described supports the material for movement down the transport 12 substantially without disturbance, e.g. substantially without mixing or tumbling, and hence as a single entity while maintaining its overall dimensions. This material advance is deemed analogous to laminar flow. The top retainer 22 cooperates in attaining the laminar flow, preventing slumping of the bed and defining the thickness of the bed. The combined effect of the top retainer 22, the slope angle and drag characteristics of the transport 12, provides this laminar downward flow, without the formation of blow holes, notwithstanding the ten percent or like shrinkage of the chips during drying.

The dryer 10 further employs a gas flow control system for introducing the flow of warm gas to the bottom of the moving bed of chip material. As shown in FIGS. 1 and 2, the illustrated dryer introduces the drying gas to the ramp bottom 20 by means of a gas inlet plenum 30 in fluid communication by an inlet duct 32 to an outside source (not shown) of the gas, which typically is heated air. The illustrated inlet plenum 30 communicates with the inlet duct 32 through a port 33 extending laterally across the ramp bottom 20, and preferably disposed closer to the top feed end 12A than the bottom discharge end 12B of the ramp bottom 20. The inlet plenum 30 is a chamber underlying substantially the entire ramp bottom 20. With this arrangement the gas passes from the inlet plenum 30, through the louver openings, through the bed of material and the top retainer 22 and into an optional exhaust collector or plenum 34 shown in FIG. 2. The illustrated exhaust plenum 34 is a mirror image of the inlet plenum 30, overlaying and open to the top retainer 22 substantially over its entire top surface area. The cooled, humidified gas so collected is routed from the exhaust plenum 34 to an exhaust duct 36 via a port 37 leading from the dryer 10. Alternatively, the exhaust gas can be passed from the bed directly to the atmosphere, as is shown in FIG. 1, without the use of an exhaust plenum or duct.

The preferred operating conditions of the dryer 10 are now described.

To attain relatively rapid drying of chips without pyrolysis and without fire hazard, the gas temperature in the inlet plenum 30 is maintained at approximately 300° F. This is below the temperature at which unacceptable emissions known as "blue haze" appear in the exhaust. To aid in avoiding entrainment of fine particles in the exhaust for environmental reasons, the flow rate of the gas is limited to no more than about 150 feet per minute through the bed, measured at the exhaust.

By using such a low gas velocity, the dryer 10 attains high thermal efficiency. Furthermore, a relatively thick bed depth can be used, while requiring only a lower static pressure, e.g., less than one inch water column, for moving the gas through the bed.

Figure 3:
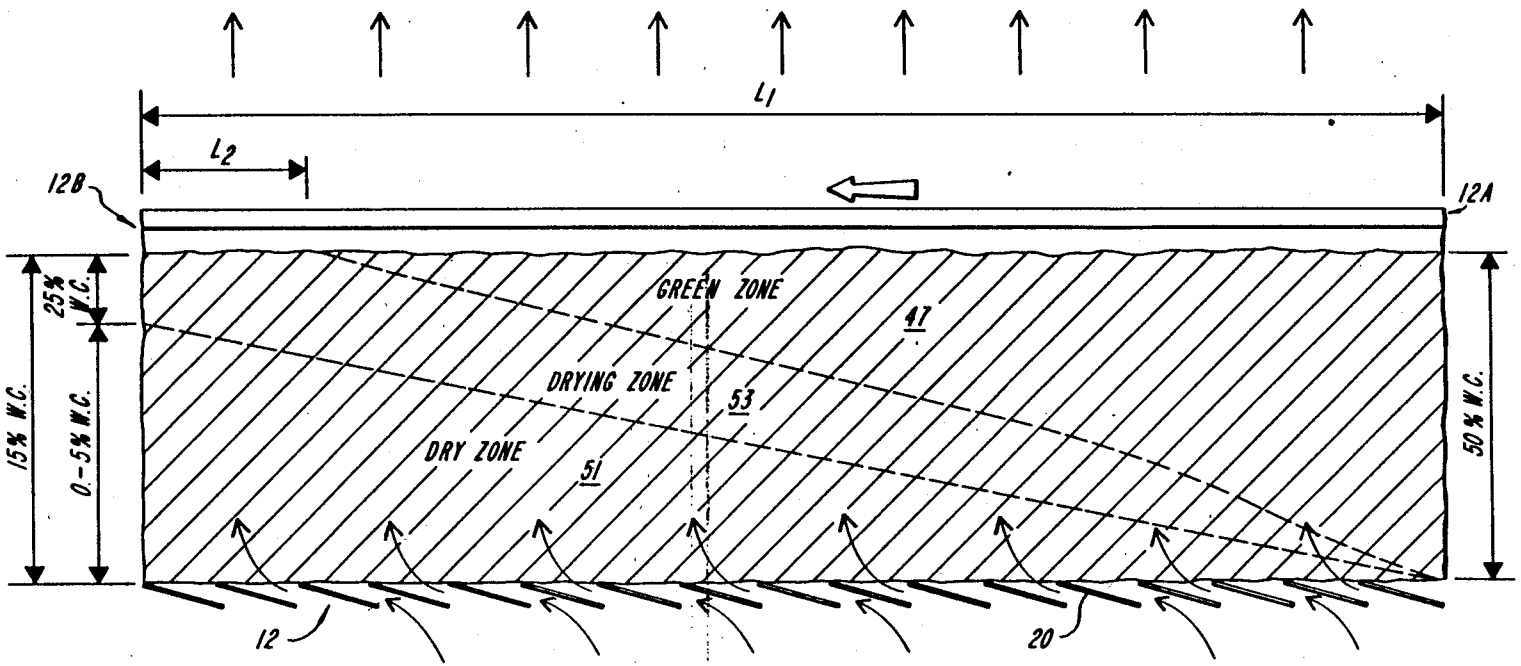
FIG. 3 is a graphic illustration of a bed of material disposed within a dryer chute in accordance with the invention, and showing the drying zone for the material.

FIG. 3 illustrates a typical drying profile which the dryer attains in a bed of chip material advancing on the transport 12. At the transport feed end 12A, the entire thickness of the material bed is wet, e.g. with a 50% water content. The material next to the ramp bottom 20 undergoes drying first, and as the material progresses along the transport, the depth of the dried material progresses into the bed.

This action establishes in the dryer 10, as FIG. 3 shows, a wedge-shaped wet or green zone 47. This zone extends along the top of the transport and has maximum thickness at the feed end 12A and progressively smaller thickness along the length of the transport toward the discharge end 12B. A dry zone 51 of material extends along the bottom of the transport with maximum thickness at the discharge end 12B and progressively smaller thickness along the length of the transport in the direction toward the feed end 12A. Between the wet zone 47 and dry zone 51 is a drying zone 53 which typically extends substantially diagonally across the dryer, as also shown. The width of the drying zone, as illustrated, typically increases relatively rapidly along the transport length near the feed end 12A.

Above the drying zone 53, the heat content of the drying gas is substantially spent, and the gas is substantially saturated. The gas passes through the green zone 47 at or below the original temperature of the wet material therein and the spent drying gas exits from the top of the transport at a temperature determined primarily by the temperature of the wet chips in the green zone 47.

The drying zone 53 typically also is wedge-shaped with minimal thickness at the end proximal to the transport feed end 12A with maximal thickness adjacent the discharge end 12B. At the feed end 12A, the drying zone is at or close to the bottom of the bed of material whereas at the discharge end the drying zone is at or near the top of the material bed, as appears in FIG. 3.

Generally it is preferred that the depth of the material bed on the transport 12 be on the order of, and preferably somewhat greater than, twice the drying zone 53 depth at the transport discharge end 12B.

Ideally, the drying zone 53 emerges at the top of the bed, and the green zone 47 ends, at the transport discharge end 12B. This is the condition of maximal efficiency. In a typical instance, the drying zone 53 emerges at the top of the bed at a distance $L_2$ from the discharge end of the transport 12, where the full length of the transport between the ends 12A and 12B as designated $L_1$. A dryer according to the invention is generally readily able to operate with the ratio of distances $L_2$ to $L_1$ less than ten, which is indicative of high thermal efficiency.

The depth of the drying zone is a function of the average wood chip size and limited moisture content. For example, to dry typical wood chips in the specific dryer detailed herein, the total bed depth is eight to ten inches (20.3 cm to 25.4 cm) and is characterized by a drying zone of between three and four inches (7.6 cm to 10.2 cm) at the discharge end 12B. For material which has a higher water content or is more finely divided, such as pelletized paper mill sludge, the bed depth is four to five inches (10.2 cm to 12.7 cm), for example, with a two inch (5.1 cm) drying zone.

With continued reference to FIG. 3, an exemplary calculation of drying effectiveness and thermal efficiency is now given for typical operating conditions of the dryer 10.

For a bed of wood chips having a 50% water content at the feed end of the transport 12, an inlet gas temperature of 300° F., and a gas exhaust temperature of 100° F., which is 30° F. above ambient, the dryer 10 can achieve an average water content of the material at the discharge end of approximately 15%. This is derived as follows: The dry zone 51 contains wood chips typically at 0 to 5% water content. The drying zone 53 at the discharge end has a depth less than the depth of the dry zone, for example, half its depth, and contains chips with typically a 25% to 30% water content. The arithmetic area average over the thickness of the bed at the discharge end yields approximately 15%.

The thermal efficiency (Eff) of the dryer 10 can be calculated for this example as follows, where $\Delta T_{IN}$ and $\Delta T_{OUT}$ are, respectively, the temperature difference between the initial and the exhaust drying gas is and the ambient air temperature:

$$\text{Eff}=(\Delta T_{IN}-\Delta T_{OUT})-\Delta T_{IN}=87\% \qquad \text{(Eq 1)}$$

Consequently, the dryer 10 in this example operates with a thermal efficiency of 87%.

Returning to the description of the dryer 10, and with continued reference to FIGS. 1 and 2, the illustrated dryer 10 further includes a material feed 40 having a feed duct 42 disposed as illustrated at the transport feed end 12A for depositing a continuous volume of material on the ramp bottom 20 sufficient to keep the chute filled. The feed duct 42 is optionally provided with a flared mouth portion, and is sized and configured to connect, for example, to the top feed end of the transport side walls 14, 16, ramp bottom 20, and top retainer 22.

Optionally, the material feed 40 is adapted to order the material according to size and dispose the smaller particles closer to the ramp bottom 20. One instance of such a material feed, shown in FIG. 2, has a vibratory filter screen 46 for filtering the material and disposing the filtrate within the chute adjacent to the ramp bottom 20. By placing the finer particles in the lower portion of the bed, the scrubbing action of the bed is enhanced. The ensuing deposits of material disposed above the fine particles tend to hold the fine particles within the bed, and to remove and hold particulates that are carried by the drying gas. Where desired, multiple screens (not shown) having different screen openings can be provided to further stratify the bed in accordance with particle size of the chip-like material. Other arrangements for achieving a desired composition profile for the bed will be apparent in light of this description to one skilled in the art.

A discharge element 48 removes the dried material at the bottom of the transport 12. The illustrated discharge element 48 has a shuttle 49 translatable at a selected rate to remove material from the dryer 10 at a rate which attains a selected drying dwell time.

The material discharge element 48 preferably cooperates with the transport 12 to selectively control the dwell time of the material in the dryer 10. Preferably, the dwell time is controlled in response to the distance from the transport discharge end to the location at which the drying zone established in the bed of material progresses to the top of the bed. In thus fashion, an improved thermal efficiency can be achieved.

In the illustrated dryer 10 of FIG. 1, a sensor 41 monitors the drying operation in the transport 12 and applies a selected operation-responsive signal to a control device 43 that in turn operates a drive device 45 to provide the desired advance-controlling discharge to the discharge element 48. This control arrangement is illustrative, for the dryer 10 can alternatively or additionally monitor exhaust gas temperature or dried chip moisture, and can control the drying air temperature, volume or speed to attain selected operation. Exhaust gas particulates can also be monitored, and controlled with control of the drying gas.

For applications in which a greater volume of material must be dried, a dryer of larger capacity is desirable. The present invention lends itself to modular construction in which a selected number of transports 12 are stacked or nested with one another. Another advantage of such an arrangement is that it requires relatively little floor space.

Multiple Transport Dryer

Figure 4:
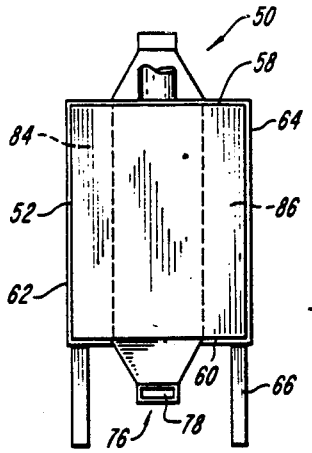
FIGS. 4, 5 and 6 are, respectively, a front elevational view, a side elevational view in section, and a top sectional view taken along line VI—VI of FIG. 5, of a modular dryer in accordance with another embodiment of the invention, with the transports stacked horizontally.
Figure 5:
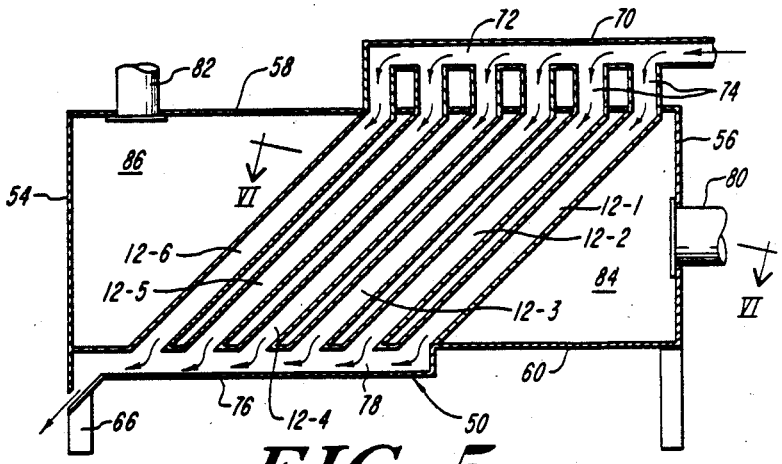

FIGS. 4 and 5 show a multi-unit horizontally arranged modular dryer 50 that has a horizontally elongated enclosure or housing 52. The illustrated housing has spaced, parallel front and back walls 54 and 56, top and bottom walls 58 and 60, and first and second side walls 62 and 64 in box-like configuration. A plurality of legs 66 support the enclosure 52. The enclosure 52 houses a set of horizontally-stacked transports 12-1, 12-2, 12-3, 12-4, 12-5, and 12-6, each constructed as described hereinabove.

As shown in FIG. 5, the transports 12 are stacked or nested horizontally, with their respective top feed ends disposed horizontally, in side-by-side relation along the enclosure top wall 58, and their respective bottom discharge ends similarly disposed along the enclosure bottom wall 60. As also shown, the several transports are nested or stacked so that the top feed end of a transport is located horizontally between the feed and discharge ends of an adjacent transport. The intervening portions of the transports 12 are disposed one over another vertically in order to conserve space within the enclosure 52. In this fashion, the modular dryer 50 houses six transports 12 in a space comparable to that which would be occupied by two single-transport dryers 10 arranged end to end, without overlap or nesting.

As further illustrated, disposed on the enclosure top wall 58 adjacent the feed end of the transports 12 of modular dryer 50 is a material feed mechanism 70. The feed mechanism 70 has a main feed duct 72, and a plurality of transport feeder ducts 74. Each transport feeder duct is connected to the main feed duct 72 at one end and to the chute of one of the transports 12 at its other end. The feed mechanism 70, which includes a material feed element (not shown) such as an auger, delivers green wood chips or other chip-like material in parallel to all of the transports 12. Each feeder duct 74 optionally can be provided with a filtering screen 46, as shown in FIG. 2.

Disposed under the enclosure bottom wall 60 adjacent the bottom feed ends of the transports 12 is a material discharge mechanism 76. The discharge mechanism 76 has a discharge duct 78 equipped with the material shuttle 49 as shown in FIG. 1, or alternatively a conveyor, picker wheel, auger, or similar device for the removal of the material.

The modular dryer 50 further includes a gas flow control system having a gas inlet port 80 extending, for example, through the enclosure back wall 56, and a gas exhaust port 82 extending, for example, through the enclosure top wall 58. Intermediate the inlet and exhaust ports are an inlet plenum 84 and an exhaust plenum 86.

Figure 6:
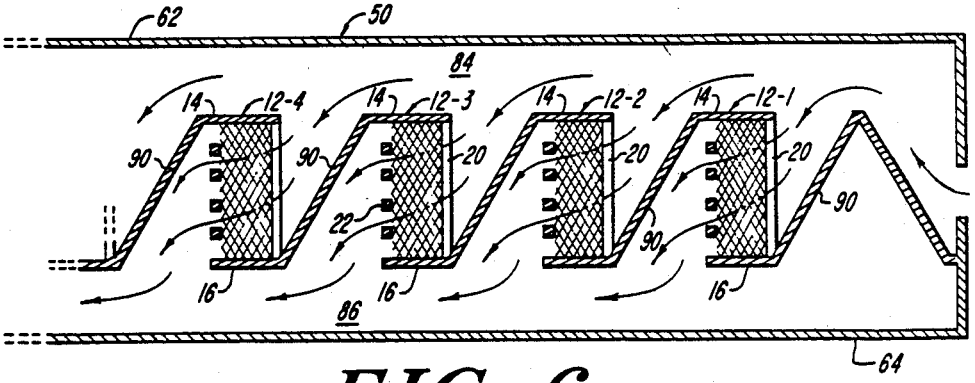

With further reference to the gas flow control system as shown in the partial sectional view of FIG. 6, the inlet plenum 84 is disposed between the first enclosure side 62 and the first side 14 of the transports 12-1 . . . 12-6. The exhaust plenum 86 is disposed between the second enclosure side 64 and the second sides 16 of the transports 12-1, 12-2, . . . The inlet plenum 84 directs warm, dry gas to the underside of each ramp bottom 20. The exhaust plenum 86 directs cooled, humidified gas from the top retainer 22 of each transport.

To aid in directing the gas, a deflector or barrier plate 90 is provided between each pair of adjacent transports 12. As illustrated, each gas-impervious deflector 90 is connected edgewise, at opposite side edges, to the first side 14 of the underneath transport, for example, transport 12-2, and to the second side 16 where the second side 16 joins the ramp bottom 20 of the overlying transport, which in the example is transport 12-3. Arranged in this fashion, each deflector 90 directs gas from the inlet plenum 84 to the entire span of the ramp bottom 20 of the overlying transport, e.g. transport 12-3, while also collecting the exhaust flow through the top retainer 22, along its entire span, of the underneath or preceding transport, e.g. transport 12-2. A further plate 90 guides drying gas to the bottom of the first transport 12-1.

With this structure of FIG. 6, each deflector 90 thus forms, in effect, an inlet plenum space that extends along, and feeds drying gas to, substantially the full length of one transport bottom. Each such plenum space receives drying gas, in parallel with the others, from the inlet plenum 84.

Figure 7:
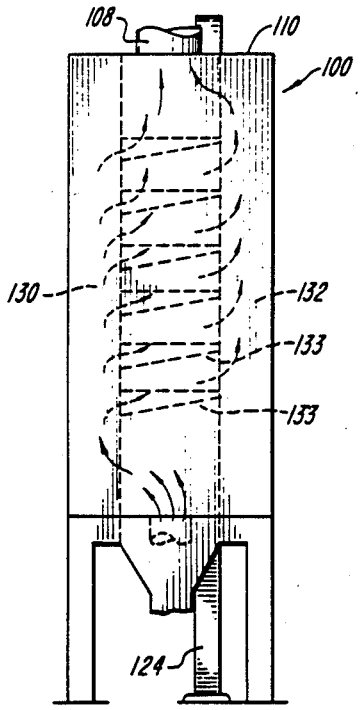
FIGS. 7 and 8 are a front elevational view, and a sectional view taken along line VIII—VIII of FIG. 7, respectively, of a modular dryer in accordance with a further embodiment of the invention, with the transports stacked vertically.
Figure 8:
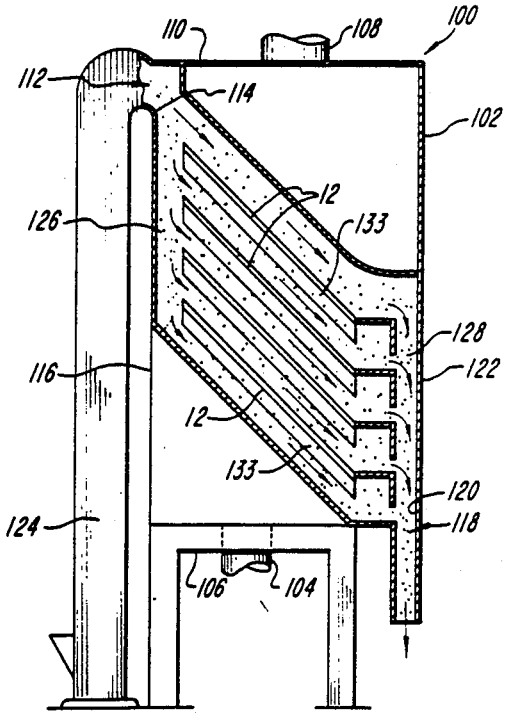

FIGS. 7 and 8 show a further embodiment of the invention in which a modular dryer 100 has multiple transports 12 stacked or nested vertically. That is, the material feed ends of the transports 12 are disposed one atop another, as are the material discharge ends. As shown, the top feed end of each transport is disposed vertically above the bottom discharge end of the next higher transport in the arrangement. The arrows in FIG. 7 illustrate flow of drying gas, and the arrows in FIG. 8 illustrate the paths of material being dried.

The modular dryer 100 further includes a box-like, vertically-elongated enclosure 102. The illustrated enclosure 102 has a gas inlet port 104 fitted to the bottom wall 106, a gas exhaust port 108 extending through the top wall 110, a material feed mechanism 112 for delivering material to the transports 12 through a feed port 114 in the back wall 116 (proximate the top wall 110), and a material discharge mechanism 118 for removing material from the transports 12 through a material discharge port 120. The material discharge port 120 extends through the bottom wall 106, proximate the enclosure front wall 122.

The illustrated material feed 112 further includes a material elevator 124 or other known feeder arrangement for delivering feed material to a main feed duct 126. The material elevator 126, which is illustrated disposed outside the enclosure 102, lifts chip material to be dried from the ground or other elevation to the material feed port 114. The main feed duct 126 extends vertically along a portion of the enclosure back wall 116, and connects the material feed port 114 in parallel to each transport chute.

The illustrated material discharge mechanism 118 further includes a main discharge duct 128 extending vertically along a portion of the enclosure front wall 122 and connecting the material discharge end of each chute to the discharge port 120.

The illustrated vertically-nested dryer 100 has a gas flow system similar to that described above for the horizontally-nested dryer 50 and having, as FIGS. 7 and 8 show, an inlet plenum 130 and an outlet plenum 132. Deflector plates 133 diagonally span across the bottom of each vertically-nested transport 12 to guide drying gas from the inlet plenum 130 to the bottom of the transport above the plate, and to guide exhaust gas from the transport below the plate to the outlet plenum 132.

Processing System

Figure 9:
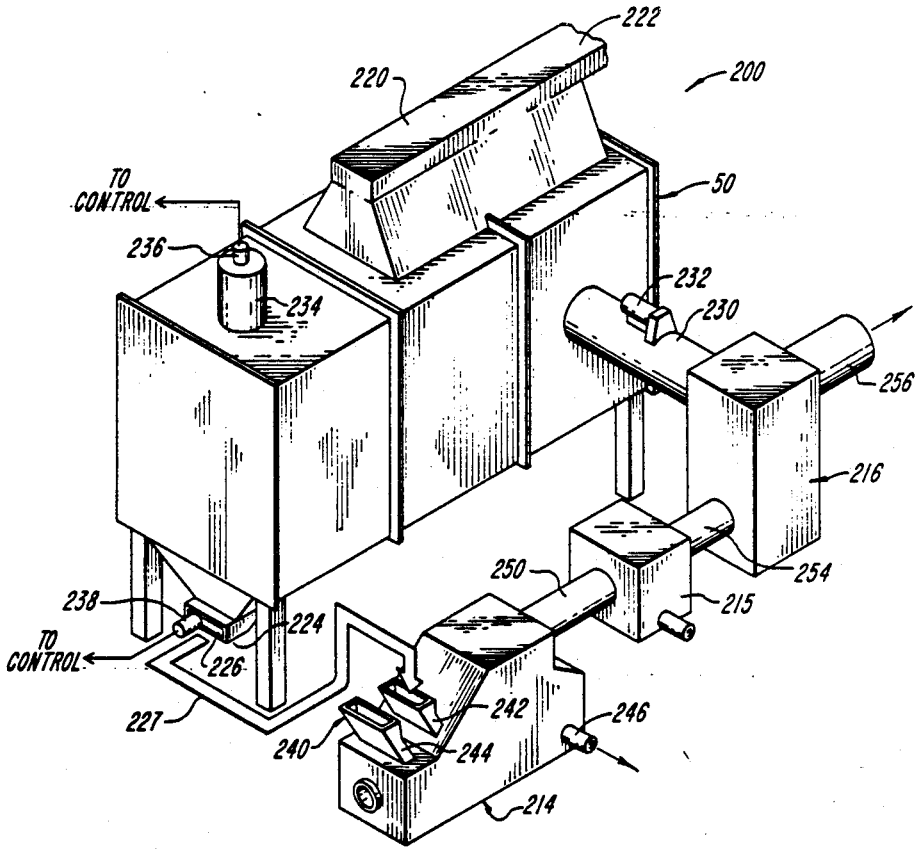
FIG. 9 is a perspective view of an illustrative processing system incorporating a dryer in accordance with the invention.

A dryer 10, 50 or 100 in accordance with the invention can be incorporated into a processing system 200 for gasifying chip-like material, as FIG. 9 shows.

The illustrated system 200 incorporates a continuous dryer 10, 50 or 100 (dryer 50 is shown for illustrative purposes), a gasifier 214, a burner 215, and a boiler 216. The system processes chip-like and flowable, combustible material with an initial relatively high water content of between 40% to 80% such as, for example, wood chips or pelletized paper sludge. The dryer of the system receives the green chips through a chip feed mechanism 220, and discharges dried chips, having a water content of approximately 12% to 15%, at a chip discharge mechanism 224 having discharge duct 226.

The illustrated system achieves drying by passing warm flue gas from the boiler 216 through the green chips, as described above. The gas is introduced into the dryer at a gas inlet 230, is preferably driven at a predetermined velocity or flow rate by a controllable fan 232. The cooled, humidified gas is discharged from the dryer 50 through a gas exhaust 234, suitably to atmosphere. The supply fan 232 can be regulated with a feedback signal that is responsive to an operating parameter of the dryer. The feedback signal can, for example, be produced with a sensor 236 disposed in the gas exhaust 224 to measure the gas humidity and/or by a sensor 238 disposed in the chip discharge mechanism 224 to measure the moisture content of the dried chips. Another option is the sense the temperature of the exhaust gas, to monitor dryer operation. The feedback signal can also be used to control the speed of a material discharge transport, such as the shuttle 49 of FIG. 1, to control drying time in the system dryer.

The illustrated gasifier 214 has an input feed mechanism 240 with a fuel inlet 242 that receives dried chips from the dryer chip discharge 224, as designated with fuel path 227. The illustrated charge-receiving mechanism 240 further has an ember inlet 244 for receiving hot embers, preferably recirculated from the gasifier 214. Proximate the bottom of the gasifier discharge end, an ash discharge 246 removes fully combusted chip material. Proximate the top of the gasifier discharge end, a gas exhaust duct 250 directs the gaseous products of pyrolysis within the gasifier into the combustion chamber 215. A second gas exhaust duct 254 is connected from chamber 215 to the boiler 216. The exhaust from the boiler 216 is provided in part to the dryer gas inlet 230 and in part through a further exhaust duct 256 for other use of the hot exhaust gas, for example, for heating, power generation or industrial processes.

The commonly-assigned application for patent Ser. No. 122,254 entitled "Reinjection Gasifier" and filed 11-18-87 concurrently herewith describe a gasifier 214 in further detail.

To generalize, the dryer in the system 200 preferably includes "n" transports, where "n" is a positive integer, typically between five and ten, inclined with respect to the horizontal between a top feed end and a bottom discharge end and extending longitudinally between the chip feed 220 and the chip discharge 224. Preferably, the transports are of modular design and are stacked or nested to handle a significant volume of chips with reduced space requirements, all in accordance with the description of the invention given above.

The invention can be embodied in other specific forms without departing from the spirit or essential characteristics thereof. The described embodiments of the invention are to be considered in all respects as illustrative and not restrictive, the scope of the invention being indicated by the appended claims rather than the foregoing description, and all changes which come within the meaning and range of equivalency of the claims are therefore intended to be embraced therein.

Having described the invention, what is claimed as new and secured by Letters Patent is:

1. A dryer for drying chip-like material, said dryer comprising

A. an inclined, transport ramp, including
  (i) first and second parallel sides,
  (ii) an inclined and generally planar ramp bottom extending longitudinally between a top feed end and a bottom discharge end and laterally between said sides for supporting a bed of said material for gravitational movement down said transport from said top feed end to said bottom discharge end,
  (iii) a gas-permeable top material-retainer in spaced, longitudinal relation to said ramp bottom and intermediate said sides, at a predetermined height above said ramp bottom, said top material-retainer, ramp bottom and sides bounding a material chute, B. means for selectively introducing a flow of warm gas to said ramp bottom for passage through said chute along its thickness dimension between said ramp bottom and said retainer, C. feed means for delivering said material to said transport at said top feed end, and D. discharge means for removing said material from said transport ramp at said bottom discharge end.

2. The dryer of claim 1 wherein said ramp bottom is inclined at an angle which is approximately five to ten degrees steeper than the natural angle of repose of the material.

3. The dryer of claim 1 further including means cooperative with said feed means for sizing and separating said material into larger and finer chips, and disposing said finer chips adjacent said ramp bottom.

4. The dryer of claim 1 wherein said ramp bottom includes a plurality of louver vanes inclined at an angle less than the incline of said ramp bottom, each pair of adjacent louver vanes defining therebetween a space through which passes gas from said introducing means.

5. Apparatus for drying chip-like particles of combustible material, said apparatus comprising A. means forming an inclined ramp-like transport for said particles, said transport means extending longitudinally between an input feed end and a discharge end, and having a longitudinal bottom and longitudinal sides, for supporting a bed of said particles having a thickness dimension perpendicular to said bottom, B. means for introducing heated gas to said transport means for passing upward through said bed of particles along said thickness dimension, said introducing means selectively distributing said introduced heated gas throughout the span of said transport means along the length thereof between said ends and along the width thereof between said sides, and C. discharge means for controlling the discharge of particles from said transport means at said discharge end, D. said transport means and introducing means and discharge means including (i) means for maintaining said bed of particles moving downwardly along said transport means from said input end to said discharge end substantially free of mixing, (ii) means for maintaining said bed of particles with air exiting from the top of said bed substantially free of entrained particulates, and (iii) means for maintaining said bed of particles with a drying zone established therein progressing to the top of said bed proximal to said discharge end.

6. Apparatus according to claim 5 in which said transport means and introducing means and discharge means are further arranged for maintaining said bed of particles with air exiting from top of said bed at temperature determined primarily by the temperature of said particles.

7. Apparatus according to claim 5 in which said transport means and introducing means and discharge means are further arranged for maintaining said bed of particles with said drying zone established therein progressing to the top of said bed at a longitudinal distance $L_2$ from said discharge end that is not greater than one-tenth the longitudinal distance $L_1$ along said transport between said feed and discharge ends.

8. Apparatus according to claim 5 wherein said ramp-like transport is inclined to the horizontal at an angle which exceeds the natural angle of repose of said chip-like particles by not more than ten degrees.

9. Apparatus according to claim 8 wherein said transport means further includes retaining means for engaging the top of said bed of particles and for maintaining said bed with a selected thickness dimension throughout the longitudinal length between said feed and discharge ends.

10. Apparatus according to claim 5

A. wherein said ramp-like transport is inclined sufficiently to support said bed of particles for gravitational advance from said feed end to said discharge end, and B. wherein said transport further comprises particle-retaining means for engaging the top of said advancing bed of particles and for supporting said particles for said advance movement in said bed substantially without slump or spillage.

11. A method for drying chip-like particles of combustible material, said method comprising the steps of A. feeding said particles onto an inclined ramp-like particle transport which extends longitudinally between an input feed end and a discharge end, and which has a longitudinal bottom and longitudinal sides and which supports a bed of said particles having a thickness dimension perpendicular to said bottom, B. maintaining said bed of particles moving downwardly along said transport from said input feed end to said discharge end substantially free of mixing, C. passing heated gas upward through said bed of particles on said transport means, D. selectively discharging particles from said transport means at said discharge end, E. maintaining said bed of particles with air exiting from the top of said bed substantially free of entrained particulates, and F. further maintaining said bed of particles with a drying zone established therein progressing to the top of said bed proximal to said discharge end.

12. A method according to claim 11 wherein said gas introducing step includes selectively distributing introduced heated gas throughout the span of said transport means along the length thereof between said ends and along the width thereof between said sides.

13. A method according to claim 11 including the further step of maintaining said bed of particles with air exiting from the top of said bed at a temperature determined primarily by the temperature of said particles being fed to said transport.

14. A method according to claim 11 further comprising the step of inclining said ramp-like transport at an angle to the horizontal of approximately not more than ten degrees above the natural angle of repose of said particles.

15. A method according to claim 11 including the step of providing said transport with particle retaining top means for engaging the top of said bed of particles.

16. A method according to claim 11 comprising the further steps of

A. inclining said transport at an angle to the horizontal for establishing gravitational movement of said particles along said transport, and B. maintaining said bed free of slumping with a selected thickness dimension throughout the length thereof between said ends.

17. A method according to claim 11

A. in which said particles include particles selected from wood chips and paper mill sludge particles, and B. said introducing step introduces air to said bed at a temperature not greater than 300° Fahrenheit.

18. A method according to claim 11 comprising the further steps of

A. feeding said particles to said transport means substantially continuously, and B. discharging said particles from said transport means substantially continuously.

19. A method according to claim 11 comprising the further step of providing said transport bottom with openings for passing said heated gas into said bed substantially without leakage of particles through said openings.

20. A method according to claim 11 including the further step of selectively controlling the dwell time of particles in said transport means in response to the distance from said transport discharge end at which said drying zone established in the bed of particles progresses to the top of said bed.

21. A method according to claim 11 including the further step of selectively controlling the drying of said particles by controlling any one of the dwell time of particles in said transport means and said passing of heated gas through said particles.

22. A dryer for flowable chip-like material, said dryer comprising

A. a dryer enclosure,

B. a plurality of nested, inclined transport ramps within said enclosure, each stationary with respect to said enclosure, and each including (i) first and second transport sides, (ii) an inclined and generally planar ramp bottom extending longitudinally between a top feed end and a bottom discharge end for supporting a gas-permeable bed of said chip-like material for gravitational movement down said transport from said feed end to said discharge end, said bed having a thickness dimension perpendicular to said ramp bottom, and (iii) a gas-permeable top material-retainer in spaced relation to said ramp bottom and intermediate said transport sides, and forming therewith a bed-supporting chute, C. means for selectively introducing a flow of warm gas in parallel to each of said ramp bottoms for passage through each of said chutes along the thickness dimension of each, and for removing cooled, humidified gas from each of said chutes, D. feed means for introducing said chip-like material to each of said transport ramps at said feed ends thereof, and E. discharge means for removing said chip-like material from said transport ramps at said discharge ends thereof.

23. The dryer of claim 22 wherein

A. said enclosure includes means forming spaced first and second side walls, spaced top and bottom walls and spaced front and back walls, and B. said gas introducing and removing means includes (i) a gas inlet plenum disposed between said first enclosure side and said first transport sides, (ii) a gas exhaust plenum disposed between said second enclosure side and said second transport sides, (iii) means for routing gas flow from said inlet plenum to said ramp bottom for passage through said bed and for routing gas flow from said bed to said exhaust plenum, (iv) gas inlet means extending through said enclosure for introducing a flow of gas into said inlet plenum, and (v) gas exhaust means extending through said enclosure for receiving a flow of gas from said exhaust plenum.

24. The dryer of claim 22 wherein said feed means includes a feed manifold having a main feed duct and a plurality of feeder ducts, each feeder duct being connected at one end to said main feed duct and at the other end to one of said bed receiving chutes at said top feed end thereof.

25. The dryer of claim 22 wherein said transports over-lie one another at least over a portion of the longitudinal extent thereof, and said routing means includes a plurality of deflectors each connected between adjacent transports with a first end of each deflector connected proximate said first side wall of the underlying transport and a second end connected proximate said second side wall of the over-lying transport.

26. The dryer of claim 22 wherein said transports are disposed in vertically stacked arrangement, with the feed end of one vertically above the discharge end of the next one above in said arrangement.

27. The dryer of claim 22 wherein said transports are disposed in horizontally stacked arrangement, with the feed end of one located horizontally between the feed and discharge ends of an adjacent one.

28. The dryer of claim 1 wherein said gas-permeable top material-retainer includes plural elements extending longitudinal with said ramp bottom and arranged for the movement of the chip-like material therealong during passage through said chute.

29. Apparatus according to claim 9 wherein said retaining means includes plural elements extending side by side and longitudinal with said bottom of said transport means and arranged for the movement of the chip-like particles therealong during passage along said transport means.

* * * * *